US008511764B1

(12) United States Patent
Chen

(10) Patent No.: US 8,511,764 B1
(45) Date of Patent: Aug. 20, 2013

(54) SLIDE AUTOMATIC-CLOSING BUFFER ASSEMBLY

(75) Inventor: Wan-Lai Chen, Taipei County (TW)

(73) Assignee: Martas Precision Slide Co., Ltd., Taipei County (TW)

( * ) Notice: Subject to any disclaimer, the term of this patent is extended or adjusted under 35 U.S.C. 154(b) by 0 days.

(21) Appl. No.: 13/401,034

(22) Filed: Feb. 21, 2012

(51) Int. Cl.
*A47B 95/00* (2006.01)

(52) U.S. Cl.
USPC ..... 312/333; 312/319.1

(58) Field of Classification Search
USPC ..... 312/333, 319.1, 334.7, 334.8, 334.44, 312/334.46, 334.47; 384/21
See application file for complete search history.

(56) References Cited

U.S. PATENT DOCUMENTS

| | | | | |
|---|---|---|---|---|
| 3,857,618 | A * | 12/1974 | Hagen et al. | 384/18 |
| 3,975,063 | A * | 8/1976 | Mahotka et al. | 384/18 |
| 6,652,050 | B2 * | 11/2003 | Lin | 312/333 |
| 6,848,759 | B2 * | 2/2005 | Doornbos et al. | 312/319.1 |
| 6,910,557 | B2 * | 6/2005 | Doornbos et al. | 188/290 |
| 6,997,528 | B2 * | 2/2006 | Yang | 312/333 |
| 7,878,606 | B2 * | 2/2011 | Chen et al. | 312/333 |
| 8,210,624 | B2 * | 7/2012 | Jurja | 312/333 |
| 2009/0033187 | A1 * | 2/2009 | Chung | 312/319.1 |
| 2009/0236959 | A1 * | 9/2009 | Liang et al. | 312/334.4 |
| 2010/0026152 | A1 * | 2/2010 | Huang | 312/319.1 |
| 2010/0164341 | A1 * | 7/2010 | Craddock | 312/334.11 |

FOREIGN PATENT DOCUMENTS

| | | |
|---|---|---|
| TW | 319465 I | 1/2010 |
| TW | 385280 M | 8/2010 |

* cited by examiner

*Primary Examiner* — Hanh V Tran
(74) *Attorney, Agent, or Firm* — Rosenberg, Klein & Lee

(57) ABSTRACT

A slide automatic-closing buffer assembly comprises a base, a sliding block, at least one elastic element and a bump. The base is disposed at an end of an outer rail, and the bump is disposed at an end of an inner rail, and the sliding block is movably installed in a containing space of the base, and the elastic element is coupled between the base and the sliding block, and the present invention is characterized in that the containing space has at least one buffer rail, and the sliding block has a buffer wheel corresponding to the buffer to rail slow down the sliding block and buffer the impact produced when the elastic element is pulled back to achieve the required automatic returning, closing and buffering effects required by a slide.

7 Claims, 5 Drawing Sheets

SLIDE AUTOMATIC-CLOSING BUFFER ASSEMBLY

BACKGROUND OF THE INVENTION

1. Field of the Invention

The present invention relates to the technical field of slide structures used in furniture such as a cupboard, in particular to a slide automatic-closing buffer assembly capable of reducing an impact to prevent the furniture from being damaged, when the slide is closed automatically.

2. Description of the Related Art

In general, a slide structure is applied between a plurality of drawers of a cabinet to facilitate users to open or close the drawers, and functions such as an interlock function of the drawers, an automatic returning and closing function, and a buffer closing function are added to the slide structure or both automatic returning and closing function and buffer closing function are integrated to improve the convenience and safety of the application.

As disclosed R.O.C. Pat. No. M385280 entitled "Improved automatic closing device for slides" and R.O.C. Pat. No. I319465 entitled "Automatic buffer closing device for slide mechanism", both automatic buffer closing devices with both automatic closing and buffer closing functions are applied to the slide structure, and each of these devices comprises an automatic-closing buckle, at least one elastic element and a buffer element, wherein the automatic-closing buckle returns and closes the slide structure automatically to prevent the slide structure from being slid and opened accidentally during a non-operating condition by using the resilience force of the elastic element the slide structure returned and closed automatically; and the buffer element is installed in the automatic-closing buckle, and a general pneumatic rod or hydraulic rod with a damping effect is provided for reducing the impact produced when the slide structure is pulled back to prevent users from being clamped or injured.

SUMMARY OF THE INVENTION

In view of the problems of the prior art, it is a primary objective of the present invention to provide a slide automatic-closing buffer assembly comprising at least one elastic element used for pulling a sliding block to return and close a slide automatically, and at least one buffer wheel and at least one corresponding buffer rail installed between the sliding block and a base to delay a sliding movement of the sliding block, so as to achieve the effect of buffering the impact produced during the automatic closing movement.

Another objective of the present invention is to provide a slide automatic-closing buffer assembly that makes use of the low price of the buffer wheel and the buffer rail to lower manufacturing cost as well as future maintenance cost.

To achieve the foregoing objective, the present invention provides a slide automatic-closing buffer assembly installed on a slide having an inner rail and an outer rail, and the assembly comprises: a base, disposed at an end of the outer rail, and linearly extended towards a front end of the outer rail, and having a containing space formed therein, a linear guide slot formed on both sides of the containing space separately, at least one buffer rail installed in the containing space, and a first positioning portion substantially in an arc shape and disposed at a front end of the linear guide slot; a sliding block, having a first protruding shaft and a second protruding shaft protruded outwardly from both sides of the sliding block respectively, and passed between the pair of linear guide slots, and the first protruding shaft having a length sufficient to pass out from the pair of linear guide slots, and the sliding block having a buffer wheel installed at a position corresponding to the buffer rail, and the buffer wheel is slowed down by the buffer rail to reduce a moving speed of the sliding block, and the sliding block having a snap groove formed therein; at least one elastic element, with an end disposed on the base, and the other end coupled to one of the first protruding shafts of the sliding block; and a bump, disposed at an end of the inner rail and opposite to a surface of the sliding block; when the inner rail is opened with respect to the outer rail, the sliding block is driven by the bump to slide in the pair of linear guide slots and turn to snap into the first positioning portion, and when the inner rail is closed with respect to the outer rail, the bump is snapped into the snap groove to push or turn the sliding block back into the pair of linear guide slots, and the sliding block is pulled in a reverse direction by the elastic element, and slides along the pair of linear slide slots to a rear end to achieve the automatic closing effect under a buffering effect of the buffer wheel and the buffer rail.

In a preferred embodiment, the base includes a cover covered onto the top of the containing space, and the cover has a snap buckle installed at both ends of the cover, and the base has a snap slot formed at a corresponding position for snapping and fixing the cover and the base with each other to facilitate the installation.

In a preferred embodiment, the slide automatic-closing buffer assembly of the present invention further comprises a second positioning portion disposed at an end of the linear guide slot, and the second positioning portion is substantially in an arc shape. If a user makes a wrong movement by mistake, the pair of the first protruding shafts change the direction and latch into the second positioning portion, and the sliding block further includes an oblique surface disposed on a side of the snap groove, and the oblique surface is situated opposite to the bump when the sliding block is snapped into the second positioning portion, such that the bump and the sliding block can resume their normal operation through the oblique surface.

DETAILED DESCRIPTION OF THE PREFERRED EMBODIMENTS

Figure 1:
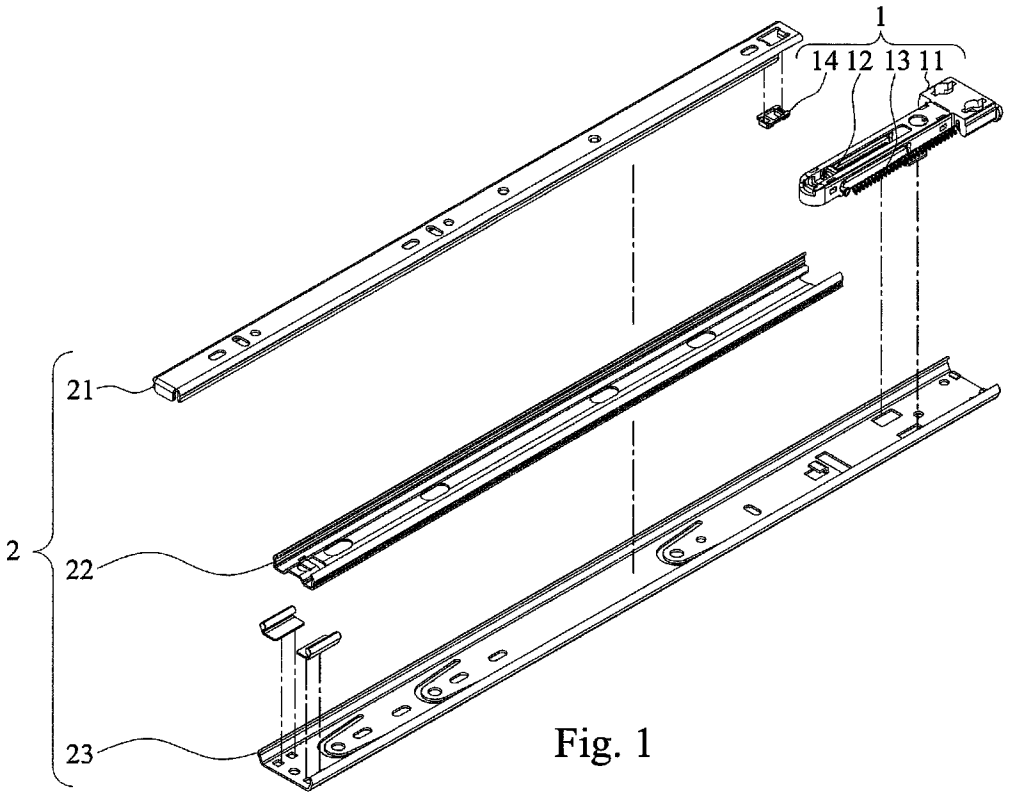
FIG. 1 is a schematic view of installing a preferred embodiment of the present invention.
Figure 2:
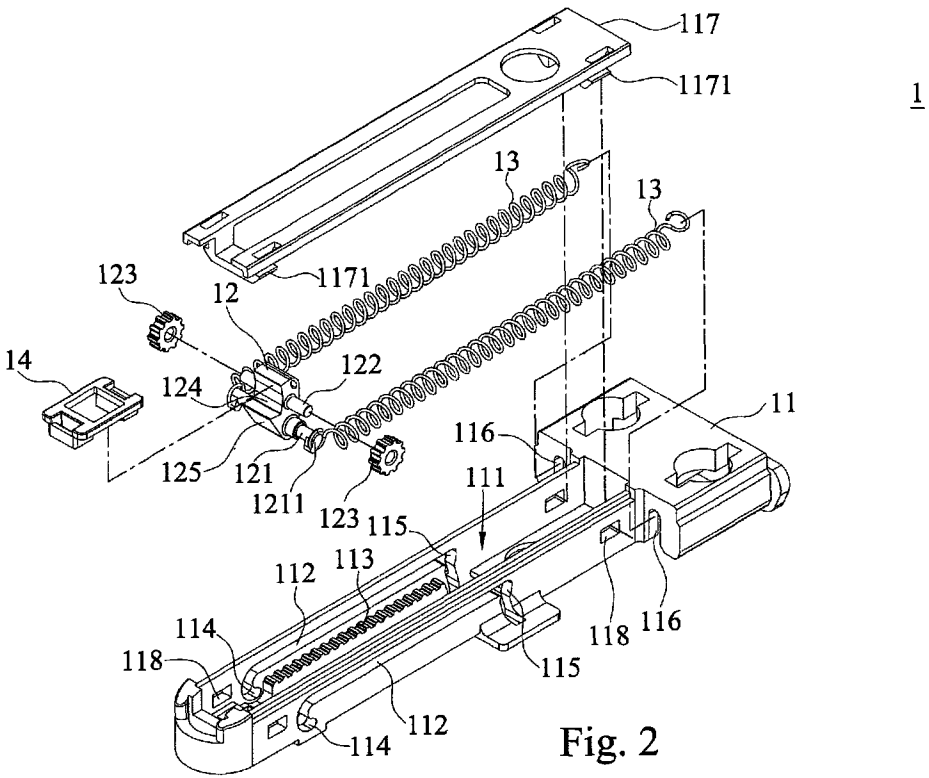
FIG. 2 is an exploded view of a preferred embodiment of the present invention.
Figure 3:
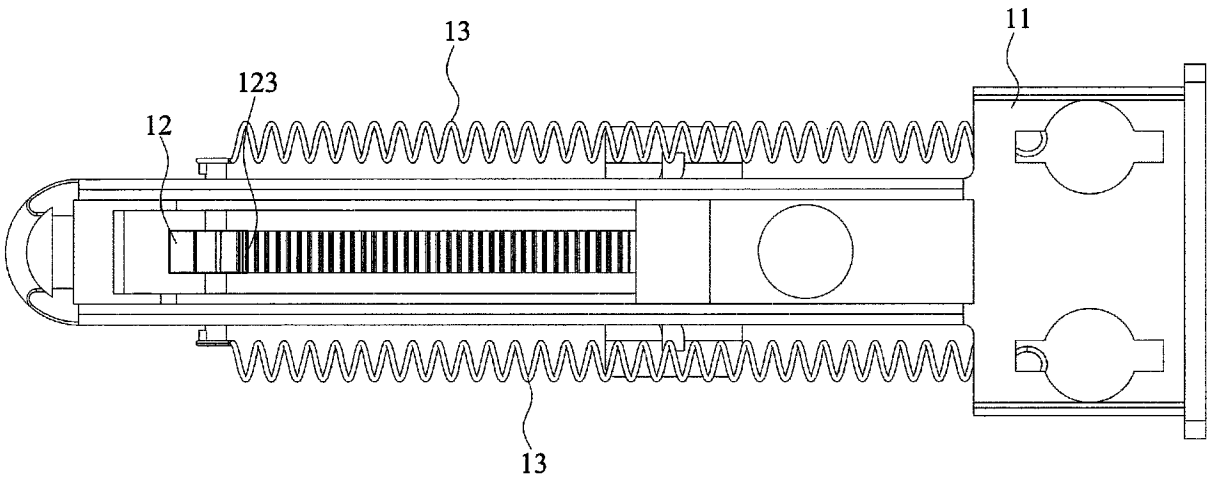
FIG. 3 is a bottom view of a base of a preferred embodiment of the present invention.

The technical content of the present invention will become apparent with the detailed description of preferred embodiments and the illustration of related drawings as follows.

With reference to FIGS. 1 to 4 for a schematic view of an installation, an exploded view, and bottom views of a base in accordance with a preferred embodiment of the present invention respectively, a slide automatic-closing buffer assembly 1 is installed on a slide 2, and the slide 2 includes an inner rail 21, a middle rail 22 and an outer rail 23, and the slide automatic-closing buffer assembly 1 comprises a base 11, a sliding block 12, a pair of elastic elements 13 and a bump 14.

The base 11 is disposed at an end of the outer rail 23 and linearly extended to a distance towards a front end of the outer rail 23, and the base 11 has a containing space 111 formed therein, a linear guide slot 112 formed on both sides of the containing space 111 separately, a buffer rail 113 installed at a center position in the containing space 111 and parallel with the pair of linear guide slots 112, and a first positioning portion 114 substantially in an arc shape and disposed at a front end of the pair of linear guide slots 112. In addition, a second positioning portion 115 is disposed separately at an end of each of the pair of linear guide slots 112, and the pair of second positioning portions 115 are in an arc shape and substantially perpendicular to the linear guide slot 112. It is noteworthy to point out that the buffer rail 113 of the present invention is a gear rack or any strip-shaped object including but not limited to a rubber strip capable of producing a friction. Further, the base 11 has a pair of fixing portions 116 corresponding to the pair of elastic elements 13 respectively.

The sliding block 12 includes a first protruding shaft 121 and a second protruding shaft 122 protruded outwardly and respectively from both sides of the sliding block 12 and movably passed between the pair of linear guide slots 112, wherein the pair of the first protruding shafts 121 have a length long enough to pass out from the pair of linear guide slots 112, and the sliding block 12 has a buffer wheel 123 installed below the center position of the sliding block 12 and corresponding to the buffer rail 113, so that the buffer wheel 123 and the buffer rail 113 are contacted with each other, and the sliding block 12 has a snap groove 124 formed thereon. It is noteworthy to point out that the buffer wheel 123 of the present invention is a gear or a rubber wheel for engaging or connecting closely with the buffer rail 113 to perform a linear movement, and thus the present invention uses engagement of the buffer wheel 123 with the buffer rail 113 or the property of a larger frictional force to slow down the moving speed of the sliding block 12. In addition, a hook 1211 is disposed at an end of the first protruding shaft 121 for hooking with the elastic element 13.

An end of the pair of elastic elements 13 is fixed into the pair of fixing portions 11 base 11 separately, and the other end is hooked onto the first protruding shaft 121 to define a connecting status, and the pair of elastic elements 13 can be a pullback spring for pulling the sliding block 12 to move towards an end of the base 11.

The bump 14 is disposed at an end of the inner rail 21 and opposite to a surface of the sliding block 12, and provided to be snapped into the snap groove 124.

To facilitate assembling the present invention, the base 11 further includes a cover 117 covered onto the top of the containing space 111, a snap buckle 1171 installed at both ends of the cover 117 separately and a snap slot 118 formed at a corresponding position of the base 11 for fixing with each other, and the sliding block 12 is disposed in the containing space 111 to prevent it from being separated or falling out.

Figure 4:
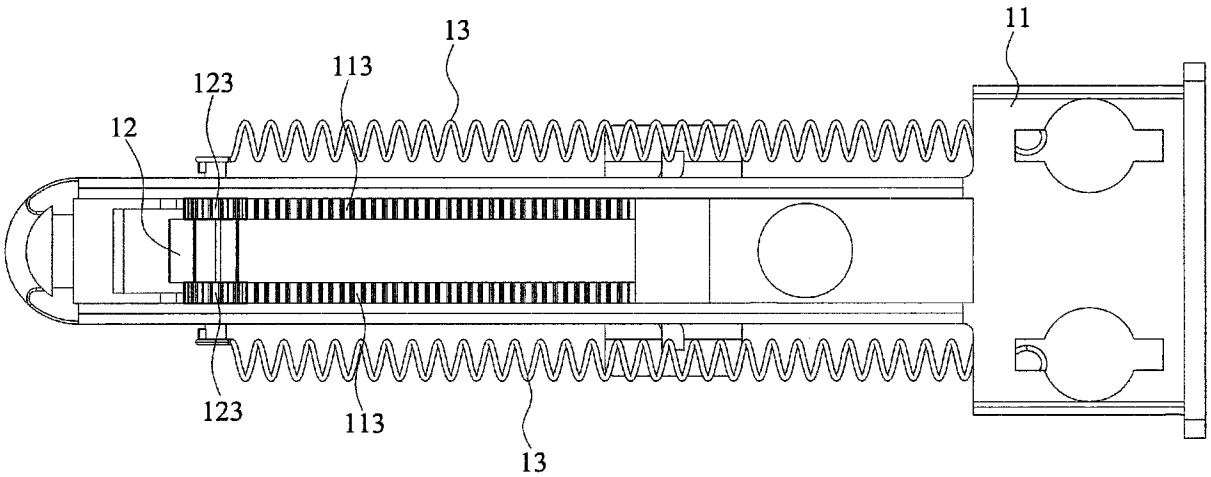
FIG. 4 is a bottom view of another preferred embodiment of the present invention.

With reference to FIG. 4, the buffer wheels 123 of the present invention are installed in a pair on the pair of second protruding shafts 122 disposed on both sides of the sliding block 12 respectively, and the buffer rails 113 are also installed in a pair on an internal side proximate to the pair of linear guide slots 112. Similarly, the buffer wheel 123 and the pair of the buffer rails 113 are engaged with each other or the friction is provided for slowing down the moving speed of the sliding block 12, and the symmetric installation also can divide the force uniformly on the sliding block 12 to make the movement more stable.

Figure 5:
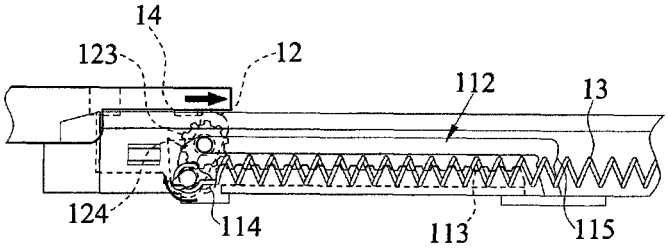
FIG. 5 is a first schematic view of continuous automatic-closing movements of a preferred embodiment of the present invention.
Figure 6:
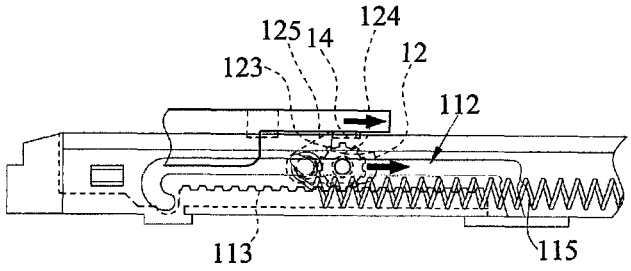
FIG. 6 is a second schematic view of continuous automatic-closing movements of a preferred embodiment of the present invention.
Figure 7:
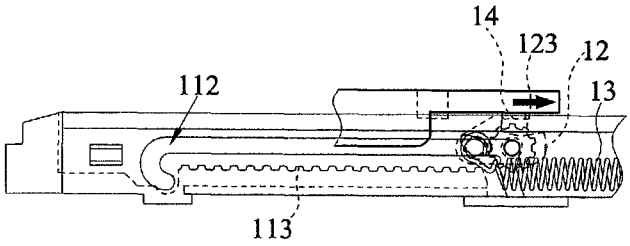
FIG. 7 is a third schematic view of continuous automatic-closing movements of a preferred embodiment of the present invention.

With reference to FIGS. 5 to 7 for schematic views of continuous automatic closing movements in accordance with a preferred embodiment of the present invention as well as FIG. 1, after a drawer is opened, the inner rail 21 is opened with respect to the middle rail 22 and the outer rail 23, and after the sliding block 12 is driven by the bump 14 to slide linearly in the pair of linear guide slots 112 and turn at the positions of the pair of the first positioning portions 114, and the pair of the first protruding shafts 122 changes their direction along the first positioning portion 114 and snaps therein to define a temporary snap. If a user wants to close the drawer, the inner rail 21 pushes the middle rail 22 and the outer rail 23 to be closed, the bump 14 will push a side of the snap groove 124 first, a pushing force in an opposite direction is exerted onto the sliding block 12 to change the direction in the pair of linear guide slots 112, so that the bump 14 is snapped into the snap groove 124, and then the sliding block 12 will return into the pair of linear guide slots 112 again. Since the sliding block 12 is pulled by the pair of elastic elements 13 in a reverse direction, and the buffering effect of the buffer wheel 123 and the buffer rail 113 is provided, the pair of linear slide slots 112 move to a rear end of the base 11 to achieve the automatic closing effect. In addition, the slide automatic-closing buffer assembly 1 may be operated accidentally by a collision when the drawer is opened, so that the sliding block 12 is returned to an end of the linear guide slot 112 and cannot be coupled with the bump 14. Therefore, the sliding block 12 has an oblique surface 125 formed on a side of the sliding block 12 and disposed on a side of the snap groove 124. For a wrong movement, the sliding block 12 is pulled by the pair of elastic elements 13 to move along the pair of linear guide slots 112 and change the direction to be snapped into the pair of the second positioning portions 115, and the oblique surface 125 is disposed in a direction opposite to the bump 14, so that users can push in the drawer again, and the bump 14 crosses the sliding block 12 through the oblique surface 125 to resume the snap connection between the bump 14 and the snap groove 124, so as to achieve the effect of positioning restoration and repeated operations.

In summation of the description above, the slide automatic-closing buffer assembly 1 of the present invention pulls the sliding block 12 by the pair of elastic elements 13 to perform the returning and closing movements automatically. During the automatic returning and closing process, an action between the buffer wheel 123 and the buffer rail 113 slows down the sliding of the sliding block 12 to achieve the effect of buffering the impact produced during the automatic closing movement. Therefore, the present invention simplifies the structural design and reduces the quantity of high-cost components such as the pneumatic rod or hydraulic rod to lower the manufacturing cost and the future maintenance cost effectively.

What is claimed is:

1. A slide automatic-closing buffer assembly, installed on a slide having an inner rail and an outer rail, comprising:

a base, disposed at an end of the outer rail, and linearly extended towards a front end of the outer rail, and having a containing space formed therein, a linear guide slot formed on both sides of the containing space separately, at least one buffer rail installed in the containing space, and a first positioning portion substantially in an arc shape and disposed at a front end of the linear guide slot;

a sliding block, having a first protruding shaft and a second protruding shaft both protruded outwardly from each side of the sliding block respectively, and passed between the pair of linear guide slots, and the first protruding shaft having a length sufficient to pass through the pair of linear guide slots, and the sliding block having a buffer wheel installed at a position corresponding to the buffer rail, wherein the buffer wheel is installed in a pair on the pair of second protruding shafts on each side of the sliding block respectively, and the buffer rail is installed in a pair on an internal side proximate to the pair of linear guide slots respectively, and the buffer wheel is slowed down by the buffer rail to reduce a moving speed of the sliding block, and the sliding block having a snap groove formed therein;

at least one elastic element, an end of the elastic element disposed on the base, and an other end of the elastic element coupled to one of the first protruding shafts of the sliding block; and a bump, disposed at an end of the inner rail and opposite to a surface of the sliding block; when the inner rail is opened with respect to the outer rail, the sliding block is driven by the bump to slide in the pair of linear guide slots and turn to snap into the first positioning portion, and when the inner rail is closed with respect to the outer rail, the bump is snapped into the snap groove to push or turn the sliding block back into the pair of linear guide slots, and the sliding block is pulled in a reverse direction by the elastic element, and slides along the pair of linear guide slots to a rear end to achieve the automatic closing effect under a buffering effect of the buffer wheel and the buffer rail.

2. The slide automatic-closing buffer assembly of claim 1, wherein the base includes a cover covered onto the top of the containing space.

3. The slide automatic-closing buffer assembly of claim 2, wherein the cover includes a snap buckle installed on both sides of the cover separately and a snap slot formed at a corresponding position of the base and snapped and fixed with the snap buckle.

4. The slide automatic-closing buffer assembly of claim 1, further comprising a second positioning portion disposed at a rear end of the linear guide slot, and the second positioning portion being substantially in an arc shape for changing a direction of the pair of first protruding shafts to be fixed therein.

5. The slide automatic-closing buffer assembly of claim 4, wherein the sliding block further has an oblique surface disposed on a side of the snap groove, and the oblique surface situated opposite to the bump when the sliding block is snapped into the second positioning portion.

6. The slide automatic-closing buffer assembly of claim 1, wherein the buffer wheel is a gear, the buffer rail is a gear rack, and the gear is engaged with the gear rack to perform a linear movement.

7. The slide automatic-closing buffer assembly of claim 1, wherein said one first protruding shaft has a hook installed at an end thereof and corresponding to the elastic element, and the base has a fixing portion corresponding to the elastic element.

* * * * *